United States Patent [19]

Grynaeus et al.

[11] Patent Number: 4,906,507

[45] Date of Patent: Mar. 6, 1990

[54] COMPOSITE ADHESIVE WEBS AND THEIR PRODUCTION

[75] Inventors: Peter S. Grynaeus, Lowell, Mass.; Gerhard Schaut, Hemsbach, Fed. Rep. of Germany; Chester J. Petkiewicz, Lowell, Mass.

[73] Assignee: Freudenberg Nonwovens Limited Partnership, Lowell, Mass.

[21] Appl. No.: 25,459

[22] Filed: Mar. 13, 1987

[51] Int. Cl.[4] ..... A41D 27/06; B32B 5/26; B32B 5/32; D04H 1/72; D04H 5/32

[52] U.S. Cl. ..... 428/113; 2/255; 428/212; 428/219; 428/288; 428/294; 428/296; 428/302; 428/311.1; 428/311.5; 428/349

[58] Field of Search ..... 2/255; 428/113, 212, 428/219, 288, 294, 296, 302, 311.1, 311.5, 349

[56] References Cited

U.S. PATENT DOCUMENTS

| | | | |
|---|---|---|---|
| 4,373,000 | 2/1983 | Knoke | 428/195 |
| 4,490,427 | 12/1984 | Grant et al. | 428/292 |
| 4,511,615 | 4/1985 | Ohta | 428/302 |
| 4,647,492 | 3/1987 | Grant et al. | 428/287 |
| 4,652,484 | 3/1987 | Shiba et al. | 428/287 |

FOREIGN PATENT DOCUMENTS 1117751 6/1968 United Kingdom .

*Primary Examiner*—James C. Cannon
*Attorney, Agent, or Firm*—Felfe & Lynch

[57] ABSTRACT

Disclosed is a composite adhesive web and a process for the production of such a web. The thermally adhesive web of the invention is comprised of a composite of randomly arranged thermoplastic filaments or, parallel thermoplastic filaments interconnected by randomly arranged thermoplastic fibers or filaments, and a fibrous thermal adhesive nonwoven sheet containing thermoplastic fibers, preferably low melting thermally adhesive fibers.

19 Claims, 1 Drawing Sheet

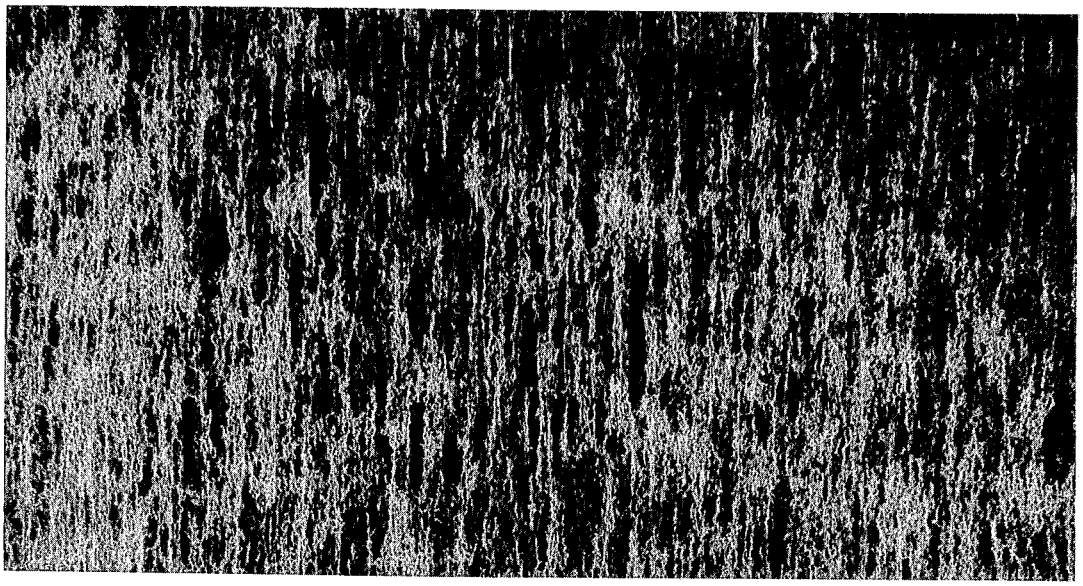

COMPOSITE ADHESIVE WEBS AND THEIR PRODUCTION

BACKGROUND OF THE INVENTION

The present invention is in a composite adhesive web and a process for its production.

British Pat. No. 1,117,751 describes the reproduction of a thermally adhesive web from a tissue of randomly arranged thermoplastic filaments. The webs are widely used in combination with nonwoven materials as stiffening interlinings, which can be ironed onto materials to be stiffened, i.e., garment parts.

In the method of the British Specification, thermoplastic material is continuously extruded and collected as a web on a continuously moving sheet. The moving sheet is preferably a nonwoven. The filaments in the web are caused or allowed to fuse to one another and to the sheet to form a fusible interlining for various apparel applications.

The thermoplastic polymers can be extruded and collected as a web on a continuously moving sheet, where the filaments are caused or allowed to fuse to one another, but not to the sheet. In this case, the tissue of the randomly arranged thermoplastic filaments bonded to one another can easily be removed from the carrying sheet to form a thermally adhesive web.

The extrusion process to form a web from randomly arranged thermoplastic filaments can be as described in British Pat. No. 1,117,751 or in a meltblown process as described in U.S. Pat. No. 3,825,380.

The webs of the prior art are useful as thermal adhesives in various textile interlining and other applications. The webs are lightweight typically weighing from 20 to 80 g/sq.m. Because the webs are thin and light, they have a rather low tensile strength. Heavier webs tend to be firm but brittle.

It is often desired to use the web in form of a tape. Typically the minimum width is 10–13 mm. However, because of the low tensile strength and/or brittleness, and because of the difficulties in handling the tape, especially using high speed mechanical handling apparatus, it is necessary to insure that the tape has sufficient tensile strength. If the tape does not have sufficient strength it will break during handling. Despite the above and other difficulties, thermally adhesive webs have been widely used and have gained recognition as important materials. However, the above-described disadvantages have imposed some constraints on their application.

A thermal adhesive web of improved tensile properties can be formed according to U.S. Pat. No. 4,490,427 which discloses a web wherein parallel filaments of thermally adhesive polymers are bonded to, and interconnected by, randomly arranged polymeric fibers. The use of parallel arranged thermoplastic filaments improves the tensile strength of such a material, but still not to the desired tensile strength.

U.S. Pat. No. 4,440,819 discloses multidirectional fiber arrays wherein graphite, glass or other fibers in substantially unidirectional arrays are interconnected with polymeric fibers. Interconnected material may subsequently be layered, impregnated with resin and laminated to yield unidirectional fibers/resins/polymer fiber composites.

However, it has been found that thermally adhesive webs of the prior art lack the desired tensile - elongation properties especially at weights over 40 g/sq.m.

SUMMARY OF THE INVENTION

The present invention is in a composite adhesive web and a process for the production of such a web. The thermally adhesive web of the invention is comprised of a composite of randomly arranged thermoplastic filaments or, parallel thermoplastic filaments interconnected by randomly arranged thermoplastic filaments, and a fibrous thermal adhesive nonwoven sheet containing thermoplastic fibers, preferably low melting thermally adhesive fibers. This fibrous thermal adhesive nonwoven sheet may comprise 10–90% of thermoplastic fibers and 90–10% of other fibers. The fibers therein are interconnected by means of heat and/or pressure, or dispersed polymeric binders or a combination of these. The thermoplastic fibers may be comprised of co-, ter-, or higher polyester or polyamides or PVC, i.e., such as a terpolymer of nylon 6, 66, and 12. The meltpoint range of the thermoplastic fibers is in the range of 75°–140° C. The thermal adhesive nonwoven sheet may comprise about 50–60% of the weight of the composite web and the thermoplastic fibers and filaments of 40–98% of the composite web. The composite has a weight of from 10 g/sq.m to 180 g/sq.m and may be in the form of a tape.

In an additional aspect of the invention, there is provided a novel and improved nonwoven sheet having inherent adhesive properties.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWING

The FIGURE is a photograph of the structure of a fibrous thermal adhesive sheet used in the invention.

DESCRIPTION OF A PREFERRED EMBODIMENT

Composite webs according to the present invention are comprised substantially of a composite of randomly arranged thermoplastic filaments, or parallel thermoplastic filaments interconnected by randomly arranged thermoplastic filaments, and a fibrous thermal adhesive nonwoven sheet, containing thermoplastic fibers.

The thermoplastic fibers may be comprised of co-, ter-, or higher polyesters, polyamides or PVC, i.e., such as a terpolymer of nylon 6, 66 and 12. The melt point range of the thermoplastic fibers is in the range of 75°–140° C.

Natural or man-made fibers used in textile applications have by the polymerchemical nature of the polymers, and by the manner of manufacturing, a much higher level of tenacity than the thermoplastic filaments used in thermally adhesive webs. The typical tensile strength of man-made staple fibers are given in Chart No. 1 (from E. Wagner: Die Textilen Rohstoffe, DFV Frankfurt/M 1981):

| Chart No. 1 | Tensile Strength | |
|---|---|---|
| | cN*/dtex | p**/den |
| PET - staple fibers | 2.0–6.5 | 2.3–7.4 |
| Nylon (PA6.6,PA6) staple fibers | 3.5–5.0 | 4.0–5.7 |
| Rayon (B-type,HT) staple fibers | 1.8–3.4 | 2.0–3.9 |

*cN = Centi Newton (.01N)
**p = pond = 0.9807 cN; 1 kp = 1000 p

Polymeric fibers in thermally adhesive webs, depending on their polymerchemical properties (i.e., lower crystallinity, less draw orientation), normally have much lower tenacity than the above-mentioned textile fibers.

| Chart No. 2 | Tensile Strength | |
|---|---|---|
| | cN/dtex | p/den |
| Co-PES filaments in thermally adhesive webs | 0.05–0.1 | 0.06–0.11 |
| Co-or Ter-PA filaments in thermally adhesive webs | 0.02–0.15 | 0.02–0.17 |

In nonwoven applications natural or man-made fibers, regardless of the fiber length, may be manufactured in the form of fibrous sheets with randomly arranged or to some extent oriented fibers, which may be interconnected by means of heat and/or pressure using high melting fibers (150°–250° C.) or dispersed polymeric binders or a combination of these procedures. These nonwoven fleeces are widely used in textile and many other applications. These nonwovens by the nature of the comprising components do not act as a thermally activated adhesive.

In this invention, natural or man-made fibers and thermally adhesive polymeric fibers, regardless of the length of these fibers, are manufactured in the form of fibrous sheets with randomly arranged or to some extent oriented fibers, which may be interconnected by means of heat and/or pressure, or dispersed polymeric binders, or a combination of these procedures. The manufactured fibrous sheets comprise 10–90% thermal adhesive polymeric fibers, preferably 30–70% and 90–10% other fibers. The thermally adhesive polymeric fibers may be comprised of co-, ter- or higher polyesters or polyamides or PVC, i.e., terpolymer of Nylon 6, 66 and 12. The meltrange of the thermal adhesive polymeric fibers is preferably 75°–140° C. or higher, but below the melting range of the contained other fibers. The dispersed polymer binder, preferably thermoplastic resin of a type such as PVAc, PVC, PES etc., if used to interconnect the thermally adhesive and other polymeric fibers, may also have thermal adhesive properties.

The arrangement of the thermal adhesive fibers and the other fibers may be random or to some extent oriented and may be manufactured on carding equipment with a subsequent interconnecting step.

The fibrous thermal adhesive sheet should be manufactured to have an open structure. The openings should be randomly arranged and are preferably 0.5–5 mm wide and 1–50 mm long. The ratio of width to length should be preferably 1:20–100, but may have extended variations. The size of the openings may be changed in further manufacturing steps. Adjacent openings may be divided just by the thickness of the comprising fiber or by more dense areas.

In the invention, the fibrous thermal adhesive sheet by its composition acts itself as a thermal adhesive, usable in apparel or nonapparel lamination processes, by means of fusing presses or heated pressure rollers. This lightweight thermal adhesive is beneficial for laminating lightweight fabrics without the crackiness of thermal adhesive films.

In the invention, the above-described fibrous thermally adhesive nonwoven sheet is combined with a thermally adhesive web with randomly arranged fusible polymeric filaments or parallel fusible polymeric filaments interconnected by randomly arranged fusible polymeric filaments. The composite may be interconnected by means of heat or pressure or a combination of both.

The thermal adhesive nonwoven sheet may comprise about 5–60% of the weight of the composite web thermoplastic fibers and filaments 40–98% of teh composite web. The weight of the composite is about 10 g/sq.m to below 180 g/sq.m. In this composite, the fibrous thermally adhesive nonwoven sheet provides the necessary tensile strength. The randomly arranged openings allow the penetration of the thermally adhesive components to either side of the nonwoven sheet if temperature and pressure are applied onto the composite. This build-up enables the composite to perform similar to an adhesive web.

In the manufacturing process, the thermally adhesive nonwoven sheet may act as a carrier onto which the thermal adhesive polymeric web is applied in a known manner of adhesive web production.

The composite of the present invention has unexpectedly improved properties, i.e. improved tensile strength; good adhesion to various outerfabrics (i.e. cotton/PES, PES, nylon, cotton, etc.) from one side to the other; and ease of manufacturing without a carrying sheet. These improved properties not only improve the manufacturing of the invention but also allow such materials to now be used for those applications where the higher strengths are mandatory or preferred.

EXAMPLE 1A

A nonwoven fleece of 12 g/m$^2$ weight was formed by a carding operation using a fibermix of 30% by weight of thermal adhesive polymeric fibers (copolyesters) 3.5d×1.5" melting at 130° C. and 70% of regular polyethylene-terephthalate (PET) staple fibers 3d×2". The interconnection for the fibers occured by using dispersed polyester based polymeric binder (Eastman WD size). A drying operation on multiple sets of steam-heated cans (Steampressure 20–30 psi) followed. The dry weight of binder added win 4 g/m$^2$ for a total weight of 16 g/m$^2$. The nonwovens sheet had a fiber:-binder ratio of 75:25 and a density of 0.039 g/cm$^3$.

EXAMPLE 1B

Onto the fleece of Example 1A, 50 g/m$^2$ of a thermally adhesive web was applied comprising a copolyester with a melting range of 130°–135° C. The forming of the composite occured by using a combination of heat and pressure by means of calender rollers. The temperature was 85° C. and the pressure was 20 psi.

EXAMPLE 2A

A nonwoven fleece of 17 g/sq.m weight was formed by a carding operation using a fibermix of 30% by weight of thermal adhesive polymeric fibers (a copolyester sold by Eastman Kodak under the designation "Kodel 438") melting at 130° C. and 70% of regular polyethylene-terephthalate (PET) staple fibers, 3 denier by 2 in. The interconnection of the fibers occurred by using a dispersed polyester based polymeric binder (Eastman WD size). A drying operation on multiple sets of steam heated cans followed. The steam pressure was 20–30 psi at 110° C. The total weight of the bonded fleece was 22 g/m$^2$.

EXAMPLE 2B

Onto the fleece of Example 2A, 62 g/m$^2$ of a thermally adhesive web was applied comprising a copolyester with a melting range of 130°–135° C. The forming of the composite occurred by using a combination of heat and pressure by means of calender rollers. The temperature was 85° C. and the pressure was 20 psi.

EXAMPLE 3A

A nonwoven fleece of 14 g/sq.m weight was formed by a carding operation using a fibermix of 50% by weight of thermal adhesive polymeric fibers, as in Example 1, and 50% of regular polyethylene-terephthalate (PET) fibers. The interconnection of the fibers occurred by using a polymeric binder, as in Example 1, with a consecutive drying operation. The total wight of the bonded fleece was 18 g/sq.m.

EXAMPLE 3B

Onto this fleece, 80 g/m$^2$ of a thermally adhesive web of a copolyester with a melting range of 110°–115° C. was applied. The forming of the composite occurred by using a combination of heat and pressure by means of calendar rollers. The temperature was 70° C. and the pressure was 20 psi.

EXAMPLE 4A

A nonwoven fleece of 10 g/sq.m weight was formed by a carding operation using a fibermix of 60% by weight of the thermal adhesive polymeric fibers, as in Example 1, and 40% of regular polyethylene-terephthalate (PET) fibers. The interconnection of the fibers occurred by using a combination of heat and pressure by means of heated calender rollers. The temperature was 105° C. and pressure was 20 kp per cm (kiloponds per cm., 1 kp=9.807 Newtons).

EXAMPLE 4B

Onto this fleece 50 g/sq.m of a thermally adhesive web was applied comprised of a terpolyamide of Nylon 6, Nylon 66 and Nylon 12 with a melting range of 110°–120° C. The forming of the composite occurred by using a combination of heat and pressure by means of calender rollers. The temperature was 70° C. and the pressure was 20 psi.

The composites of the invention show improved tensile strengths as recorded in Table 1.

TABLE 1

(Tensile/elongation properties of composite adhesive webs)

| Type of therm. adhesive web | Area Weight (g/sq.m) | Tensile Strength (N/in.)** at break | Weight Related Tensile (Nm/g)**** | Elongation at break (%) |
|---|---|---|---|---|
| Random PA*-Web | 30 | 5.9 | 7.74 | 59 |
| Random PA*-Web | 20 | 2.6 | 5.12 | 110 |

TABLE 1-continued (Tensile/elongation properties of composite adhesive webs)

| Type of therm. adhesive web | Area Weight (g/sq.m) | Tensile Strength (N/in.)** at break | Weight Related Tensile (Nm/g)**** | Elongation at break (%) |
|---|---|---|---|---|
| Random PES***-Web | 45 | 3.3 | 2.89 | 54 |
| Composite Web Ex. #1B | 66 | 20.4 | 12.17 | 41 |
| Composite Web Ex. #2B | 84 | 24.7 | 11.58 | 30 |
| Composite Web Ex. #3B | 96 | 17.9 | 12.34 | 27 |
| Composite Web Ex. #4B | 60 | 17.9 | 11.75 | 42 |

*Nylon terpolymer of the Pellon SL8 type
**Newtons per inch
***Polyester Copolymer of the Pellon SP 20 type
****Newton-meter/gram It will be understood that the specification and examples are illustrative but not limitative of the present invention and that other embodiments within the spirit and scope of the invention will suggest themselves to those skilled in the art.

We claim:

1. A composite comprising a thermally adhesive nonwoven sheet and randomly arranged fusible polymeric filaments wherein the thermally adhesive nonwoven sheet contains 10–90 wt. % of fusible polymeric fibers with a melt range of 75° to 140° C. and has openings of 0.5 to 5 mm wide.

2. The composite of claim 1, wherein the total content of thermal adhesive or fusible fibers and filaments is maximum 98%.

3. The composite of claim 1, wherein the thermal adhesive filaments are co-, ter- or higher polyesters or polyamides or PVC.

4. The composite of claim 1, wherein the thermally adhesive nonwoven sheet is bonded by heat and/or pressure or dispersed polymeric binders or a combination thereof.

5. The composite of claim 1, wherein the thermally adhesive nonwoven sheet has randomly arranged openings, which enable the penetration of the fusible polymeric components to either side of the nonwoven.

6. The composite of claim 1, wherein is produced with or without a use of an external carrier.

7. The composite of claim 1, wherein the thermally adhesive nonwoven sheet is 5–60% by weight of the composite.

8. The composite of claim 1, wherein the fusible polymeric fibers of the thermally adhesive web and the thermally adhesive nonwoven sheet have the same or different chemical and physical properties.

9. The composite of claim 1, having a weight of about 10 g/sq.m to 180 g/sq.m.

10. The composite of claim 1 in the form a sheet or in the form of a tape.

11. The composite of claim 1 wherein the openings are 1 to 50 mm long.

12. A composite comprising a fibrous thermally adhesive nonwoven sheet having openings of 0.5 to 5 mm wide and parallel fusible polymeric filaments interconnected by randomly arranged fusible polymeric filaments.

13. The composite of claim 12, wherein the thermally adhesive nonwoven sheet contains 10–90 wt. % of fusible polymeric fibers.

14. The composite of claim 12, wherein the total content of thermal adhesive or fusible fibers and filaments is maximum 98%.

15. A thermally adhesive nonwoven sheet comprising 10–90 wt. % of thermally adhesive or fusible fibers wherein the thermally adhesive fibers have a melt range of 75°–140° C. and the sheet has openings of 0.5 to 5 mm.

16. The thermally adhesive nonwoven sheet of claim 15, wherein the thermally adhesive fibers are co-, ter- or higher polyesters or co-, ter- or higher polyamides or PVC.

17. The thermally adhesive nonwoven sheet of claim 15, wherein the thermally adhesive sheet is bonded by heat and/or pressure or dispersed polymeric binders or a combination thereof.

18. The thermally adhesive nonwoven sheet of claim 15, having a weight of about 9–110 g/sq.m.

19. The thermally adhesive nonwoven sheet of claim 15 wherein the openings have a ratio of width of length of 1:20–100.

* * * * *

UNITED STATES PATENT AND TRADEMARK OFFICE

CERTIFICATE OF CORRECTION

PATENT NO. : 4,906,507

DATED : March 6, 1990

INVENTOR(S) : Peter S. Grynaeus et al

It is certified that error appears in the above-identified patent and that said Letters Patent is hereby corrected as shown below:

Column 2, line 25, "50-60%" should read --5-60%--.

Column 4, line 20, "teh" should read --the--.

Column 4, line 54, "win" should read --was--.

Column 5, line 27, "wight" should read --weight--.

Signed and Sealed this

Twenty-sixth Day of November, 1991

*Attest:*

HARRY F. MANBECK, JR.

*Attesting Officer*

*Commissioner of Patents and Trademarks*